United States Patent [19]

Szamosi

[11] 3,990,379

[45] Nov. 9, 1976

[54] DREDGING APPARATUS

[75] Inventor: Peter Szamosi, Rotterdam, Netherlands

[73] Assignee: N.V. Industrieele Handelscombinatie Holland, Rotterdam, Netherlands

[22] Filed: Feb. 24, 1975

[21] Appl. No.: 552,122

[52] U.S. Cl. ..... 114/36; 37/58; 37/72; 61/107; 175/103; 242/54 R

[51] Int. Cl.[2] ..... B63B 35/00; E02F 3/88; B65H 75/34

[58] Field of Search ..... 114/36, 51, 210, 235 F; 37/54, 58, 72, DIG. 8, 59, 61; 285/184, 283, 24; 61/72.3, 72.5, 72.6; 175/103; 254/192; 242/1, 54 R, 84.4

[56] References Cited

UNITED STATES PATENTS

| | | | |
|---|---|---|---|
| 2,010,539 | 8/1935 | Evans | 37/61 |
| 2,623,704 | 12/1952 | Bergman et al. | 242/84.4 |
| 2,780,196 | 2/1957 | Jareckie | 114/210 |
| 3,228,371 | 1/1966 | Rosenberg | 114/51 |
| 3,395,665 | 8/1968 | Rosenberg et al. | 114/51 |
| 3,629,963 | 12/1971 | Itami | 37/54 |
| 3,659,712 | 5/1972 | Chaplin | 37/59 |
| 3,681,862 | 8/1972 | Koning et al. | 37/72 |
| 3,828,451 | 8/1974 | Koning et al. | 37/72 |
| 3,911,690 | 10/1975 | Gracia | 61/72.3 |

FOREIGN PATENTS OR APPLICATIONS

| | | | |
|---|---|---|---|
| 332,306 | 10/1903 | France | 37/72 |

*Primary Examiner*—Trygve M. Blix
*Assistant Examiner*—Charles E. Frankfort
*Attorney, Agent, or Firm*—Young & Thompson

[57] ABSTRACT

A marine dredging apparatus has a dredging aggregate that is connected to the surface by means of a plurality of articulatedly interconnected rigid pipe sections that can be wound up on a prismatic reel that in turn is disposed on, in or around a vessel. To facilitate winding in a helical configuration, the axis of the prismatic reel is disposed at an angle to the horizontal.

5 Claims, 6 Drawing Figures

DREDGING APPARATUS

The invention relates to a dredging apparatus consisting of a vessel, a dredging aggregate which can be lowered to the bottom and raised and a hollow connecting piping between this aggregate and the vessel, through which the loosened material may be conveyed. Such dredging apparatuses are generally known. The dredging aggregate may consist of a rotating cutter at the lower end of the suction piping supplied with a suction head. In case of an increasing water depth, the storage of a similar piping creates a problem. It is known, in fact, that, between the dredging aggregate and the vessel, a hose is fixed which can be wound up on a drum. Since such a hose should have a fairly large inner diameter and be proof against heavy strain, it is very costly while, none the less, damage cannot be avoided. Moreover, such a hose, being flexible, has the disadvantage that its path under water is determined by currents produced in the water. In the case of great depth the dredging aggregate is sometimes constructed as an independent unit, supplied with its own means for the displacement of the aggregate, with means to loosen the soil and with a suction pump. In that case, a non-controllable path of the connection between this aggregate and the vessel may be most inconvenient.

The object of the invention is to provide a solution for the aforesaid problems and this object is achieved according to the invention, due to the fact that this connection between the dredging aggregate and the vessel consists of an articulated pipe, the various sections of which are hinged together, and which articulated pipe is fastened to and can be wound up on an elongated prismatic reel. Such a connection is less vulnerable while the path of such a connection consisting of pipe sections is easily controllable. Although the entire articulated pipe may have hinge joints which can be moved in all directions, it is preferred that at least some of the pipe joints have hinges with only one shaft. The path of the piping can then be determined easily.

Moreover, it will be possible either to construct the hinges in such a manner that they are fixable or to limit their freedom of movement by means of stops. Also, according to the invention, it will be possible to construct the hinges in such a manner that they are adjustable by means of hydraulic jacks or suchlike adjusting motors, so that the articulated pipe may be assigned any desired path. Thus, for instance, it will be possible to let the articulated pipe proceed from the vessel over part of the depth in a stiff condition and held rigidly to the vessel by means of cables.

According to the invention, the articulated pipe is fastened to and can be wound up on an elongated prismatic reel. This prismatic reel has sides whose width essentially corresponds to the length of a section of the articulated pipe. If necessary, these sides of the prismatic reel may be supplied with outwardly movable supports, by means of which the width of the sides of the fictitious prism may be adapted to possible variations in the lengths of the sections of the piping. Such variations may be due to tolerances in the manufacture, to wear and to stretch. The shaft of the prismatic reel is preferably mounted at a small angle with respect to the horizontal so that the articulated pipe will be automatically wound up at the desired pitch. Furthermore, the prismatic reel may be supplied with an axial discharge conduit which, via a radial connection, leads to the extremity of the articulated pipe fastened to the prismatic reel.

Such a prismatic reel, with the articulated pipe wound around it, may be placed upon the deck of the vessel and brought outboard by means of a sliding or swinging device for the lowering of the articulated pipe.

However, according to the invention, it will also be possible to place the prismatic reel with the articulated pipe in a well of the vessel, whereby the articulated pipe may be lowered through an opening in the bottom. This opening may be kept small if the prismatic reel is supported in a horizontally movable manner so that, during the unwinding, a displacement takes place, corresponding to the pitch of the wound up articulated pipe. For the winding up, the displacement should take place in the opposite direction.

Apart from the placing of the prismatic reel on or in the vessel already mentioned, it will also be possible to place the prismatic reel around the vessel. It is preferred that the prismatic reel have large dimensions as the pipe joints may then also have great lengths. This prismatic reel placed around the vessel may be given its own buoyancy and, eventually, be disconnectable to the extent that the vessel may sail in and out of it.

Also, it is conceivable to construct the prismatic reel as an independent unit and to supply it with stabilizers and/or rotation gear. Embodiments are then conceivable where the apparatus may operate either independently or together with a vessel suitable or not for coupling. The rotation of the prismatic reel may then be effected from the vessel suitable for coupling via the stabilizers or by means of ballast tanks.

The invention will now be further illustrated with the aid of the drawings representing schematically several embodiments of the invention.

Figure 1:
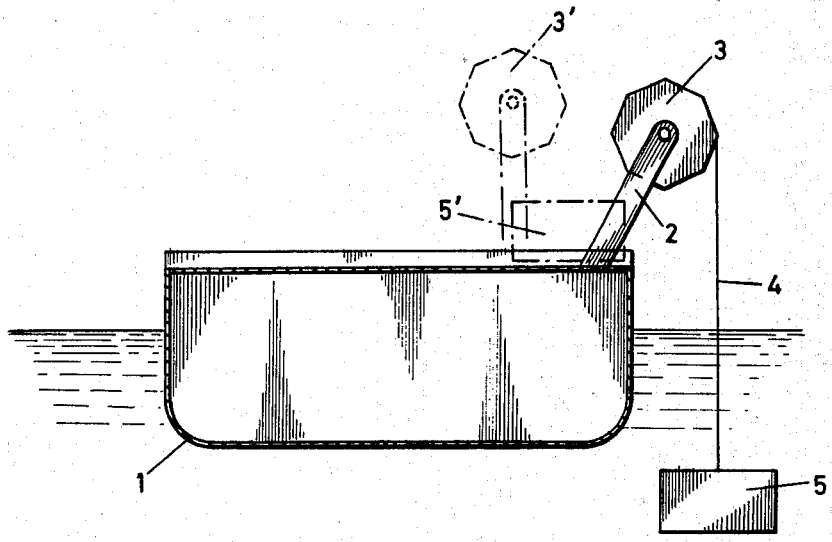
FIG. 1 is a schematic representation of the cross profile of the apparatus according to the invention.

The vessel 1 shown in FIG. 1 has on deck a set of outwardly swingable arms 2, supporting between them an elongated prismatic reel 3, on which the articulated pipe (schematically indicated by the line 4) is wound. The arms 2 can be swung from the position 3′ — indicated with dotted lines — to the position indicated with full lines. The dredging aggregate is indicated by 5, 5′.

Instead of the embodiment with outwardly swinging arms as shown in FIG. 1, other embodiments are conceivable, such as transverse displacement by means of a bridge.

Figure 2:
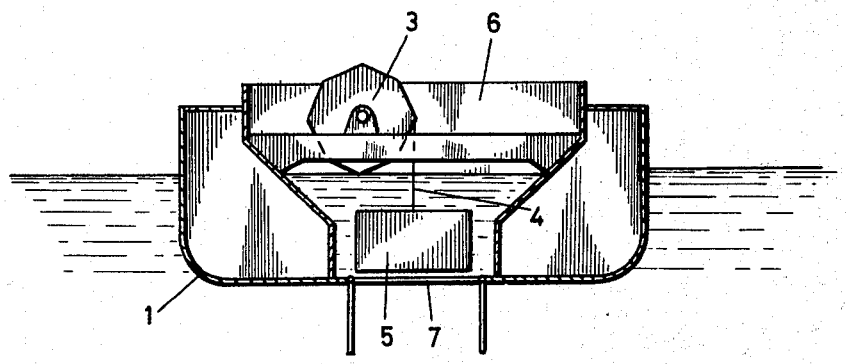
FIG. 2 shows a preferred embodiment in section.

In the embodiment according to FIG. 2, the prismatic reel 3 with the articulated pipe 4 is placed in the well 6 of the vessel and the articulated pipe 4 may be lowered and hoisted respectively through an opening 7 which can be closed off. In this way, the vessel's centre of gravity is kept low and eventual repairs may be carried out if the opening 7 is closed and the well 6 pumped dry.

Figure 3:
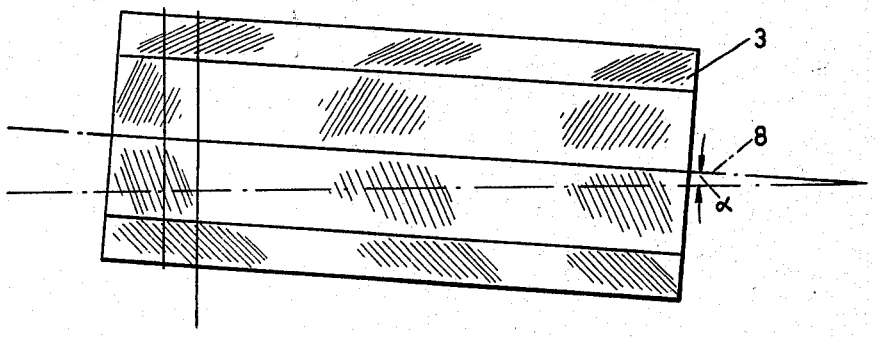
FIG. 3 shows a side view of the prismatic reel.

FIG. 3 is an outline of the prismatic reel in side view. This prismatic reel 3 may consist of a drum or frame work of a polygonal section, rotatable around a shaft 8 at an angle $\alpha$ with the horizontal. This angle causes the articulated pipe to be wound up and unwound respectively in the desired helical pattern.

The articulated pipe itself may be constructed according to various methods known per se. Thus, the hinged connection may be a spherical hinge. It will also be possible, however, to supply the extremities of the single pipe sections with hinge arms which are connected with one another via hinge shafts, and to place short lengths of hose between the extremities of the pipe sections.

Figure 4:
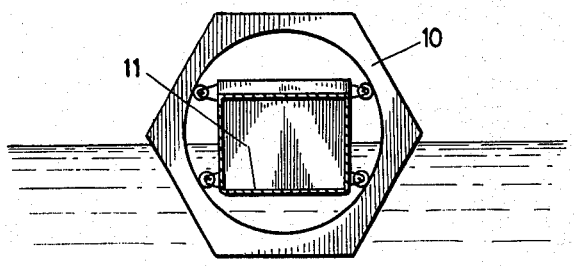
FIGS. 4 and 5 show a variant, both in section and in top plan view.
Figure 5:
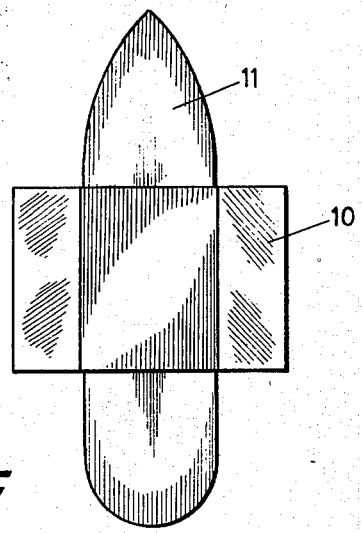

In the embodiment as shown in FIGS. 4 and 5, the prismatic reel 10 is located rotatably around the hull of the vessel 11. This prismatic reel may have buoyancy and be dimensioned and coupled with the vessel with the possibility of being taken apart in such a manner that the vessel may be sailed in and out of it. Indeed, a similar embodiment of the prismatic reel should then be supplied with stabilizers capable of absorbing the couple which may be exercised by the articulated pipe.

Figure 6:
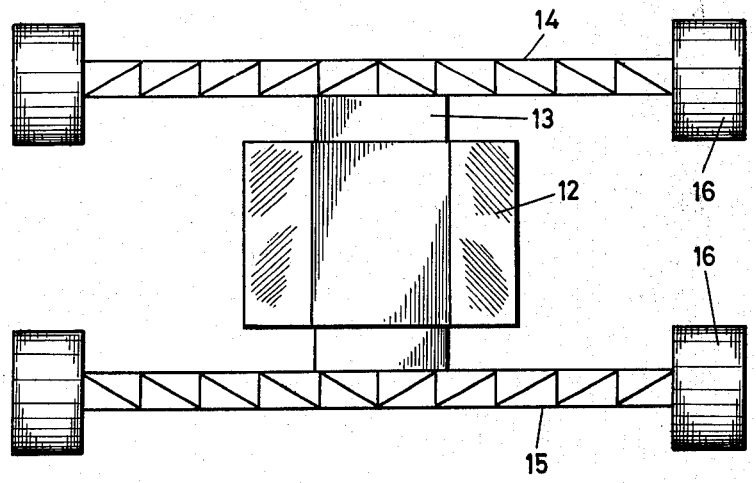
FIG. 6 shows yet another embodiment in top plan view.

FIG. 6 shows an embodiment in which the prismatic reel 12 bears upon a casing 13 having arms 14 and 15 with floats 16. This embodiment forms an independent dredging unit. The discharge may be effected in such a manner that connection with vessels coming alongside will be possible.

For stabilization, other possibilities are conceivable, such as tanks to be placed in the prismatic reel and which are set out around the center line and successively filled with ballast in order to generate the desired couple.

I claim:

1. A dredging apparatus consisting of a vessel, a dredging aggregate which can be lowered to the bottom and raised, and a hollow connecting piping between this vessel and the aggregate, through which the loosened material may be conveyed, characterized in that said piping consists of an articulated pipe, comprised by a plurality of rigid pipe sections which are articulatedly interconnected and which articulated pipe is fastened to and wound up on an elongated prismatic reel.

2. A dredging apparatus according to claim 1, characterized in that said prismatic reel is located rotatably around the hull or part of the hull of the vessel.

3. A dredging apparatus according to claim 1, characterized in that the prismatic reel is an independent unit with its own buoyancy.

4. A dredging apparatus according to claim 1, characterized in that the longitudinal axis of the prismatic reel makes an angle with the horizontal.

5. A dredging apparatus according to claim 1, characterized in that the prismatic reel is placed in a well in the vessel.

* * * * *